US007895997B2

(12) United States Patent
Lee et al.

(10) Patent No.: US 7,895,997 B2
(45) Date of Patent: Mar. 1, 2011

(54) HEATING COOKING APPLIANCE AND BURNER SYSTEM OF THE SAME

(75) Inventors: Dae Rae Lee, Gimhae-si (KR); Jung Wan Ryu, Changwon-si (KR); Dae Bong Yang, Jinhae-si (KR); Sang Min Lyu, Changwon-si (KR); Yong Ki Jeong, Busan (KR); Young Soo Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 23 days.

(21) Appl. No.: 11/932,155

(22) Filed: Oct. 31, 2007

(65) Prior Publication Data

US 2008/0149090 A1 Jun. 26, 2008

(30) Foreign Application Priority Data

Dec. 20, 2006 (KR) ..... 10-2006-0130607

(51) Int. Cl.

| | |
|---|---|
| ***F23C 5/02*** | (2006.01) |
| *F23C 5/08* | (2006.01) |
| *F23D 14/02* | (2006.01) |
| *F23D 14/46* | (2006.01) |
| *F24C 3/00* | (2006.01) |
| *F24C 3/08* | (2006.01) |

(52) U.S. Cl. ..... 126/39 E; 126/39 R; 126/39 N; 126/39 K; 431/343

(58) Field of Classification Search ..... 431/343; 126/39 E, 39 H, 39 J, 39 K, 39 N, 39 R, 116 R
See application file for complete search history.

(56) References Cited

U.S. PATENT DOCUMENTS

| | | | | | |
|---|---|---|---|---|---|
| 566,329 | A | * | 8/1896 | Magee | 126/39 R |
| 623,237 | A | * | 4/1899 | Crossland | 126/39 R |
| 643,067 | A | * | 2/1900 | Magee | 126/39 R |
| 670,740 | A | * | 3/1901 | Sheppard | 126/39 K |
| 1,199,842 | A | * | 10/1916 | Walker | 126/39 R |
| 1,379,538 | A | * | 5/1921 | De Silva | 239/397.5 |

(Continued)

FOREIGN PATENT DOCUMENTS

CN 2254518 Y 5/1997

(Continued)

OTHER PUBLICATIONS

Modine Mfg. Co.; Installation & Service Manual—Gas Fired Unit Heaters Model PDP #6-579.2; Feb. 2004; p. 11.*

*Primary Examiner* — Steven B McAllister
*Assistant Examiner* — Daniel E Namay
(74) *Attorney, Agent, or Firm* — Birch, Stewart, Kolasch & Birch, LLP

(57) ABSTRACT

A heating cooking appliance and a burner system of the same are provided. A nozzle and a mixing tube can be stably fixed, and relative position of components can be aligned with high precision even if the heating cooking appliance has a narrow internal space. Thus, operational reliability of the heating cooking appliance is improved, and an operator can easily assemble the burner system. To this end, a nozzle coupling part is configured to fix a position of a nozzle, and a mixing tube coupling part is configured to fix a position of the mixing unit. The nozzle coupling part and the mixing tube coupling part are partially coupled to achieve a precise relative positional relation between the nozzle and the mixing tube.

9 Claims, 7 Drawing Sheets

U.S. PATENT DOCUMENTS 1,735,618 A * 11/1929 O'Dowd ..... 431/348
1,735,654 A * 11/1929 O'Dowd ..... 126/39 J
1,959,657 A * 5/1934 Chambers ..... 126/214 R
1,988,394 A * 1/1935 O'Dowd ..... 126/39 H
2,298,307 A * 10/1942 Parker ..... 126/39 H
2,730,662 A * 1/1956 Perl ..... 361/264
3,042,110 A * 7/1962 Weber et al. ..... 431/349
3,092,169 A * 6/1963 Lohman ..... 431/191
3,196,927 A * 7/1965 Alger ..... 239/505
3,219,098 A * 11/1965 Fulmer ..... 431/349
3,468,298 A * 9/1969 Teague, Jr. et al. ..... 126/39 J
3,540,428 A * 11/1970 Alvarez ..... 126/39 H
3,606,612 A * 9/1971 Reid ..... 431/281
3,633,562 A * 1/1972 Morse et al. ..... 126/39 J
3,906,974 A * 9/1975 Chevallier ..... 137/15.09
4,083,355 A * 4/1978 Schwank ..... 126/39 J
4,570,610 A * 2/1986 Himmel ..... 126/39 E
4,580,550 A * 4/1986 Kristen et al. ..... 126/39 J
4,597,733 A * 7/1986 Dean et al. ..... 431/285
4,872,578 A * 10/1989 Fuerschbach et al. ..... 165/167
5,125,390 A * 6/1992 Riehl ..... 126/39 R
5,380,193 A * 1/1995 Williams et al. ..... 431/178
5,405,263 A * 4/1995 Gerdes et al. ..... 431/354
5,509,403 A * 4/1996 Kahlke et al. ..... 126/39 E
5,704,778 A * 1/1998 Hsieh ..... 431/354
5,903,439 A * 5/1999 Tamarkin ..... 361/742
6,030,207 A * 2/2000 Saleri ..... 431/354
6,076,517 A * 6/2000 Kahlke et al. ..... 126/39 J
6,089,219 A * 7/2000 Kodera et al. ..... 126/39 R
6,263,868 B1 * 7/2001 Koch et al. ..... 126/39 R
6,497,570 B1 * 12/2002 Sears et al. ..... 431/178
6,537,065 B1 * 3/2003 Shirali et al. ..... 431/354
6,860,734 B2 * 3/2005 Zia et al. ..... 431/354
7,083,123 B2 * 8/2006 Molla ..... 239/419.5
7,766,005 B2 * 8/2010 Lee et al. ..... 126/39 J
2003/0077551 A1 * 4/2003 Zia et al. ..... 431/354
2004/0150226 A1 * 8/2004 Hystad ..... 285/368
2009/0173333 A1 * 7/2009 Kwon et al. ..... 126/39 E

FOREIGN PATENT DOCUMENTS

CN 2674296 Y 1/2005
FR 2692024 A1 * 12/1993

* cited by examiner

HEATING COOKING APPLIANCE AND BURNER SYSTEM OF THE SAME

CROSS-REFERENCE TO RELATED APPLICATIONS

The present application claims priority under 35 U.S.C. 119 and 35 U.S.C. 365 to Korean Patent Application No. 10-2006-0130607 (filed on Dec. 20, 2006), which is hereby incorporated by reference in its entirety.

BACKGROUND

The present disclosure relates to a heating cooking appliance, and more particularly, to a heating cooking appliance and a burner system of the same, which are configured to have a small size, achieve high burning efficiency, reduce air-flow resistance, and facilitate assembly thereof.

Heating cooking appliances are devices that cook food by heat. Particularly, a gas cooktop among the heating cooking appliances cooks food by heat generated through gas combustion. The cooktop is also called a hot plate or a hob, and is being increasingly used.

A burner system is employed in the cooktop operating by gas combustion. The burner system mixes a combustible gas with air to generate combustion. The burner system sprays a gaseous fuel through a nozzle, and introduces air together with the gaseous fuel into a mixing tube, using a decrease in air pressure around the sprayed gaseous fuel. A gas mixture introduced into a burner pot through the mixing tube is mixed again uniformly within the burner pot, and then combusts on a glow plate. Heat generated by the combustion is transferred to food by heat radiation and conduction to heat and cook the food.

To improve operational reliability of the burner system, the mixing tube, the nozzle and the burner pot must be precisely concentrically aligned, and the mixing tube and the nozzle must be installed and maintained at the same preset distance. If the components are not concentrically aligned or the distance between the components is different from the set value, the gas and air cannot be uniformly introduced, and the ratio of air to gas is reduced. This causes incomplete combustion, increasing emissions of carbon monoxide.

In the case of the general burner system, to meet the aforementioned requirements, the mixing tube is coupled to the burner pot, and the nozzle is firmly coupled to a case of a heating cooking appliance.

In order to improve user satisfaction and reduce material cost, heating cooking appliances are becoming more compact, and especially in the case of cooktops, compactness is essential to prevent a cooktop from protruding upward from a counter.

SUMMARY

Embodiments provide a heating cooking appliance and a burner system of the same, which can allow a nozzle and a mixing tube to be stably fixed even in a narrow heating cooking appliance, and can allow relative positions of components to be aligned with high precision.

Embodiments also provide a heating cooking appliance, and a burner system of the same, which can prevent misalignment of components and can allow a nozzle, a mixing tube, and a burner pot to be placed at preset positions with high precision by allowing an operator to easily align components of the burner system relative to one another.

In one aspect, a heating cooking appliance comprises: a case; a plate covering a top side of the case; a burner system in an internal space defined by the plate and the case; and an exhaust part at one edge of the plate, wherein the burner system includes: a nozzle unit provided with at least one nozzle to spray gas; a mixing tube unit provided with at least one mixing tube through which the gas and air are introduced, the mixing tube maintained a predetermined distance apart from the nozzle; a burner pot to uniformly mix the gas and air which are introduced through the mixing tube unit; a nozzle coupling part fixing a position of the nozzle; and a mixing tube coupling part fixing a position of the mixing tube.

In another aspect, a burner system comprises: a nozzle configured to spray gas; a mixing tube spaced apart from the nozzle to introduce the gas and air; a burner pot providing a mixing space in which the gas and air introduced through the mixing tube are uniformly mixed; a nozzle leg configured to fix a position of the nozzle; a mixing tube leg configured to fix a position of the mixing tube; and a coupling member to partially connect the nozzle leg with the mixing tube leg.

In a further aspect, a burner system comprises: a nozzle unit provided with at least one nozzle configured to spray gas; a mixing tube unit provided with at least one mixing tube apart from the nozzle to introduce air together with the gas therein; a burner pot providing a mixing space in which the gas and air introduced through the mixing tube unit are uniformly mixed; a nozzle coupling part configured to fix a position of the nozzle; a mixing tube coupling part configured to fix a position of the mixing tube; and a guide unit configured to align at least a part of the nozzle coupling part with at least a part of the mixing tube coupling part so that a relative positional relation between the nozzle unit and the mixing tube unit is precisely set.

Accordingly, the heating cooking appliance can be easily assembled, and components of the burner system can be precisely placed, so that the burner system can be stably and efficiently operated, and the components of the burner system can be placed at desired positions even when the heating cooking appliance has a compact structure.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Embodiment 1

Figure 1:
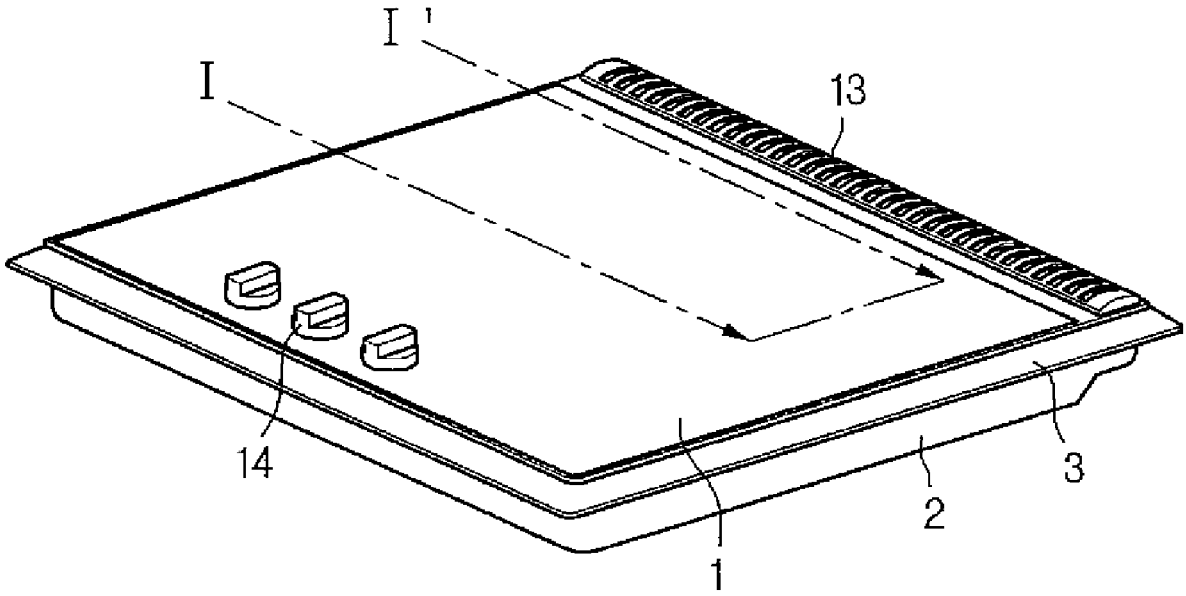
FIG. 1 is a perspective view of a heating cooking appliance according to a first embodiment.
Figure 2:
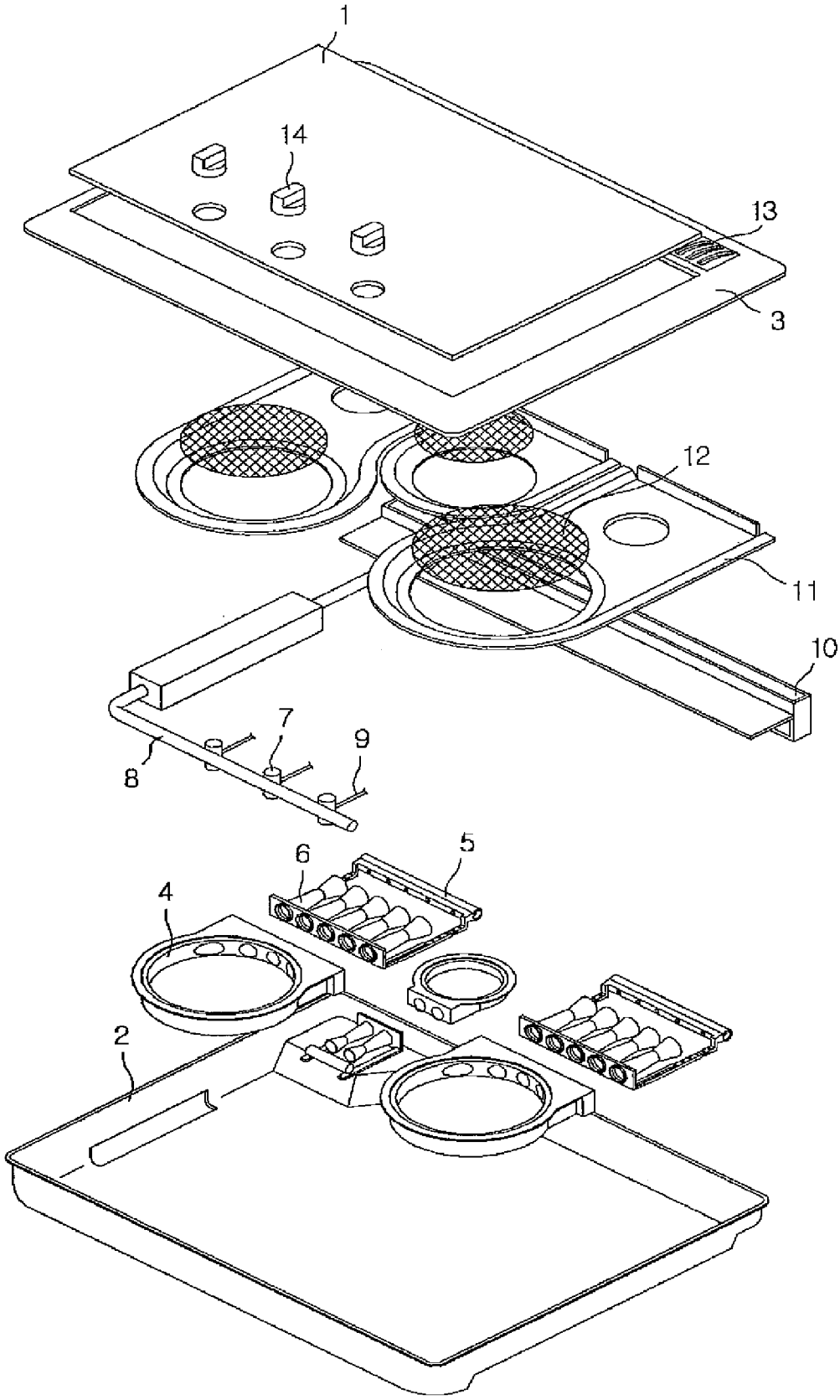
FIG. 2 is an exploded perspective view of a heating cooking appliance of FIG. 1.

FIG. 1 is a perspective view of a heating cooking appliance according to a first embodiment, and FIG. 2 is an exploded perspective view of the heating cooking appliance of FIG. 1.

Referring to FIGS. 1 and 2, the heating cooking appliance includes a case 2, a ceramic plate 1, and a top frame 3. The case 2 protects a lower side of a body, forms an entire bottom exterior of the heating cooking appliance, and is opened at a top side. The ceramic plate 1 is mounted on the top side of the case 2, and the top frame 3 covers an edge portion of the ceramic plate 1. A further exterior structure of the heating cooking appliances includes an exhaust grill 13 formed at the rear of the heating cooking appliance and serving to discharge exhaust gas, and at least one switch 14 formed roughly on the front side of the ceramic plate 1 and controlling ON/OFF of gas combustion. The exhaust grill 13 and the switch 14 may be variously implemented, but the construction of an exhaust unit for exhausting a combustion gas, and a switching unit for controlling ON/Off of gas combustion is necessary.

A plurality of components for gas combustion and gas exhaust, and control of the heating cooking appliance are received in an internal space defined by the case 2 and the ceramic plate 1. This will now be described in detail.

In FIG. 2, three burner pots 4 are illustrated. Each burner pot 4 serves to mix the gas and the air enough to achieve uniform combustion. A mixing tube unit 6 is placed at a side surface of each burner pot 4 so that a gas mixture is supplied through the side surface of the burner pot 4. A nozzle unit 5 is placed at a predetermined distance from an inlet of each mixing tube unit 6, and serves to spray a gas toward the inlet of the mixing tube units 6.

A burner frame 11 is placed on the burner pot 4. The burner frame 11 supports the burner pot 4, and provides an exhaust path of a combustion gas having combusted on a glow plate 12.

An exhaust part 10 and the exhaust grill 13 are placed at the rear of the burner frame 11. The exhaust part 10 and the exhaust grill 13 on the exhaust part 10 serve to exhaust the combustion gas to the outside.

The glow plate 12 on each burner pot 4 is heated by high-temperature heat generated when the gas mixture combusts. When the glow plate 12 is heated, radiation energy of a frequency band corresponding to a physical property of the glow plate 12, preferably, a frequency band of infrared light, is emitted. The radiation energy of the glow plate 12 includes at least a frequency band of visible light, which allows a user to recognize that the heating cooking appliance is in operation. Of course, food is heated by radiation heat of the glow plate 12 and conduction heat of the ceramic plate 1.

A structure of gas supply to the nozzle unit 5 will now be described.

A gas is supplied through a main gas supply tube 8 from the outside of the heating cooking appliance. A gas valve 7 controlled by the switch 14 controls the gas supply toward each burner system. The gas having passed through the gas valve 7 is supplied to the nozzle unit 5 through the gas supply tube 9.

Figure 3:
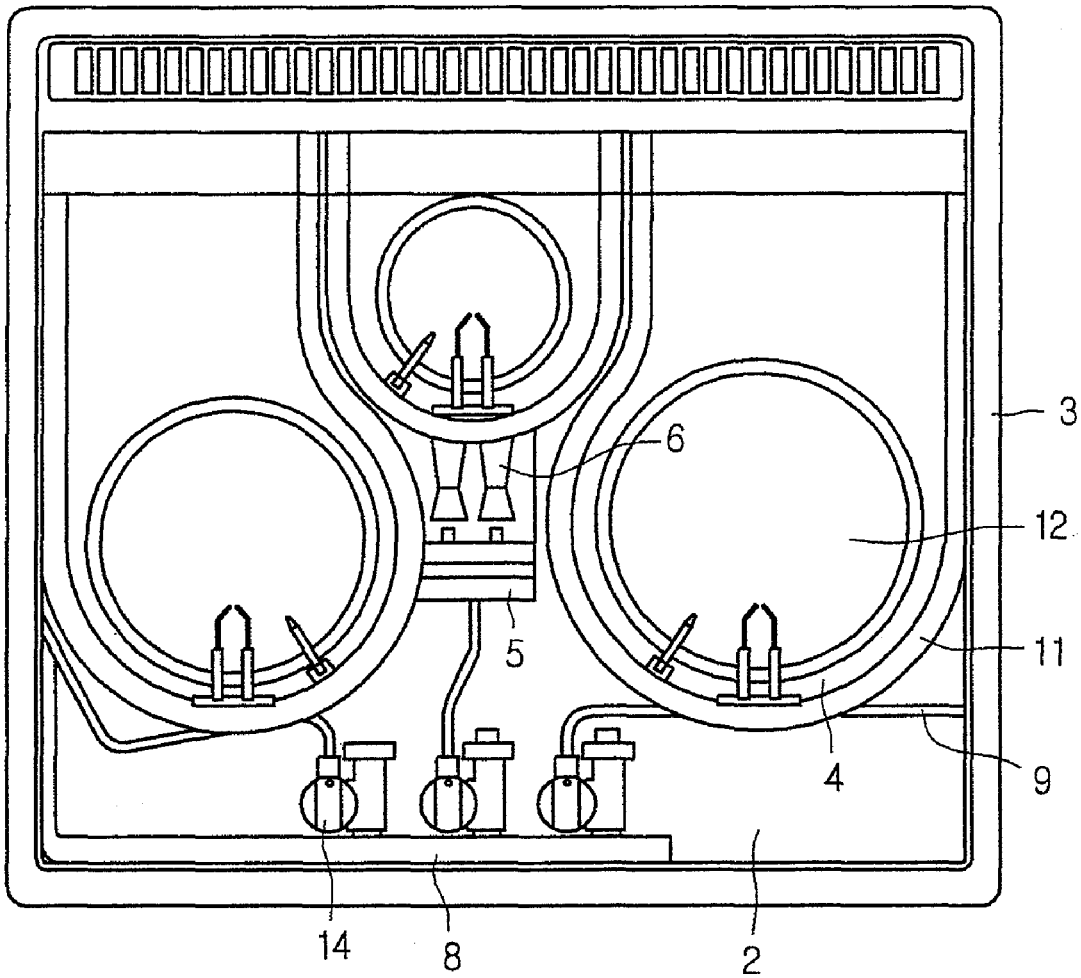
FIG. 3 is a plan view of a heating cooking appliance of FIG. 1, excluding a ceramic plate.

FIG. 3 is a plan view of the heating cooking appliance of FIG. 1. In FIG. 3, the ceramic plate 1 is excluded.

In FIG. 3, two of the burner pots 4 have relatively large sizes and are placed on both sides of the case 2, and the remaining one has a relatively small size and is provided between the two relatively large burner pots 4. Thus, a user may place a cooking container to be heated on one of the burner pots 4 according to heating values of the burner pots 4.

In the relatively small burner pot 4 placed at the center of the case 2, a gas mixture is mixed again while supplied from a front side toward a rear side of the burner pot 4. After the gas mixture combusts on the glow plate 12, the gas is exhausted rearwardly, that is, toward the exhaust part 10. In the two relatively large burner pots 4 placed on both sides of the case 2, a gas mixture is mixed again while supplied from a rear side toward a front side thereof. Then, the gas mixture combusts on the glow plate 12, and is exhausted rearwardly of the burner pot 4.

The disposition of the burner pots 4 is for implementing an optimum heating burner system.

The positioning of components within the heating cooking appliance can be easily observed through FIG. 3.

A burner system of the heating cooking appliance according to a first embodiment has a structure that allows stable flow of the gas and air while maintaining minimal heights of the burner system and the heating cooking appliance, can stably maintain a ratio of the air to the gas (hereinafter, referred to as an air ratio), and can ensure assemblability of the burner system.

The structure and operation of the burner system of the heating cooking appliance will now be described in detail.

Figure 4:
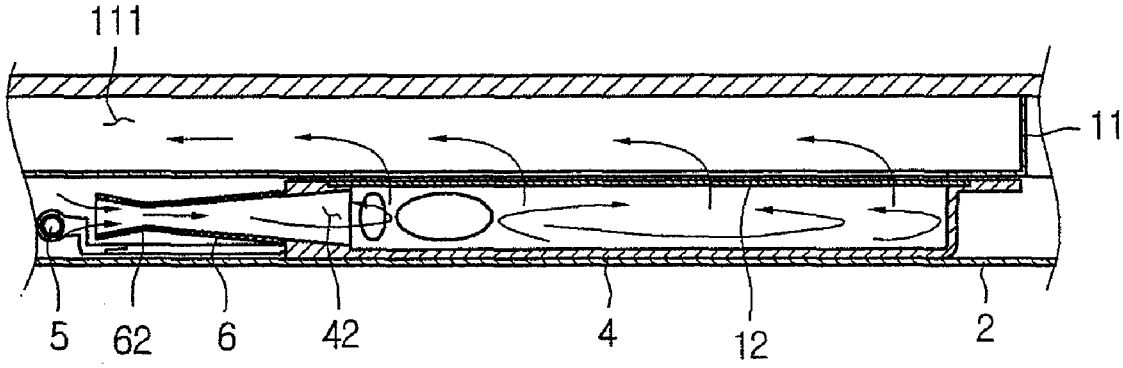
FIG. 4 is a sectional view taken along line I-I' of FIG. 1, illustrating a burner system according a first embodiment.
Figure 5:
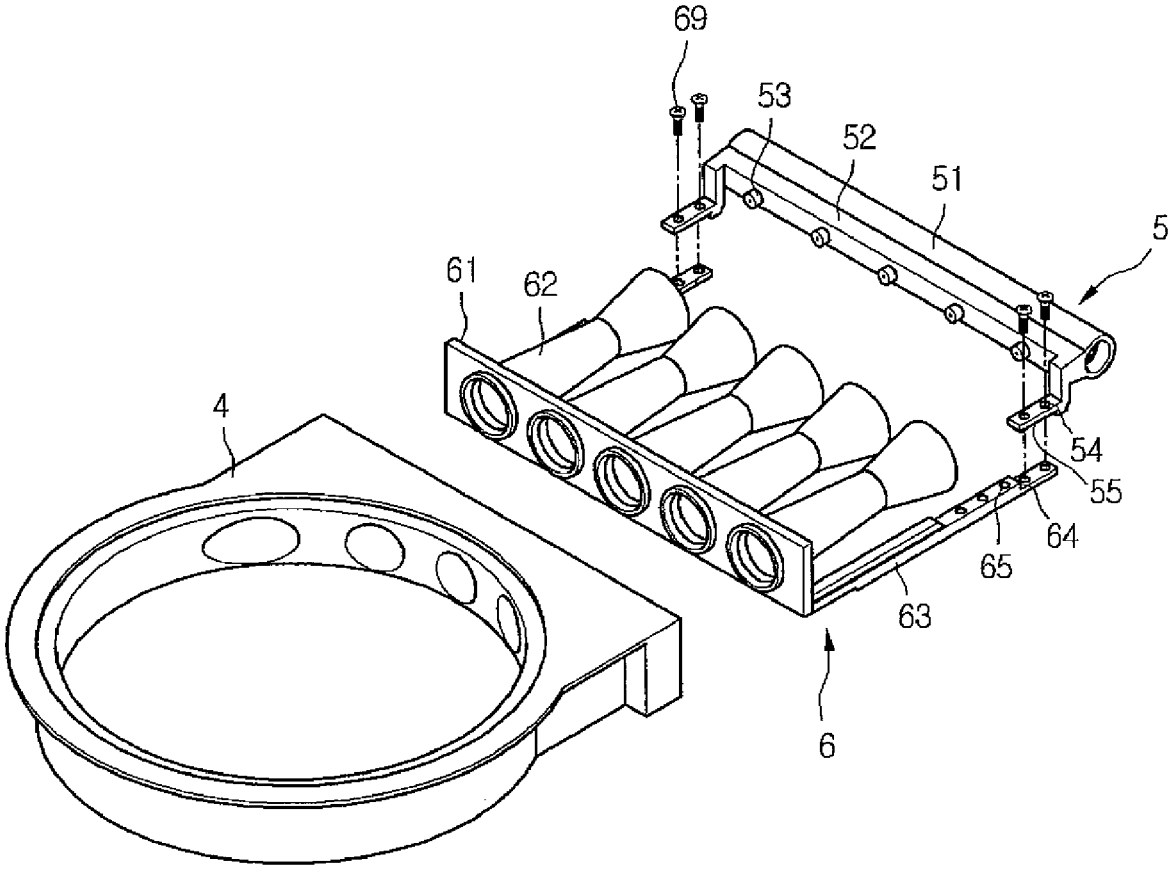
FIG. 5 is a perspective view of a burner system of FIG. 4.

FIG. 4 is a sectional view taken along line I-I' o FIG. 1, illustrating a burner system according to a first embodiment. FIG. 5 is a perspective view of the burner system of FIG. 4.

Referring to FIG. 4, the burner pot 4 is provided on the case 2. The mixing tube unit 6 is disposed at a side surface of the burner pot 4. The nozzle unit 5 is disposed adjacent to the inlet of the mixing tube unit 6 at a predetermined distance.

The operation of the burner system will now be described. A gas sprayed from the nozzle unit 5 is introduced into the mixing tube unit 6 at a high speed. The gas passes through the inlet of the mixing tube unit 6 at such a high speed that an adjacent space to the inlet of the mixing tube unit 6 becomes a low-pressure state according to Bernoulli's Theorem. Therefore, ambient air is introduced into the mixing tube 62 together with the gas, and thus a fluid passing through the mixing tube 62 becomes a gas mixture of the gas and air. The gas mixture having passed through the mixing tube unit 6 is introduced into an internal space of the burner pot 4 through an opening 42, and is mixed again and combusts on the glow plate 12. Combustion heat of the gas mixture heats the glow plate 12 to make the plate 12 red, and then radiation heat is generated from the glow plate 12.

In order to introduce a maximum quantity of air when the gas sprayed from the nozzle unit 5 is introduced into the mixing tube unit 6, it is important to concentrically align the nozzle unit 5 and the mixing tube unit 6 to maintain the distance between the nozzle 5 and the mixing tube unit 6. Even though the nozzle unit 5 and the mixing tube unit 6 are designed to maintain the proper relative positional relation therebetween, this positional relation may be deviated during a manufacturing process or in use. If the positional relation is deviated, the amount of air being suctioned may decrease, flow resistance of the burner system may increase, and incomplete combustion may occur.

Therefore, a support structure is proposed, which allows the nozzle unit 5 and the mixing tube unit 6 to be placed at preset positions with high precision.

Referring to FIG. 5, the nozzle unit 5 includes a distribution tube 51 in which a gas flows, a nozzle holder 52 provided in front of the distribution tube 51, and a plurality of nozzles 53 fixed on the nozzle holder 52 at regular intervals. Nozzle legs 54 extend from both end portions of the nozzle holder 52 toward the mixing tube unit 6. The mixing tube unit 6 includes a plurality of mixing tubes 62, a mixing tube support 61 supporting the mixing tubes 62, and mixing tube legs 63 extending from both end portions of the mixing tube support 61 toward the nozzle unit 5. Also, the burner pot 4 is placed in front of the mixing tube unit 6 as a separate component from the mixing tube unit 6, and is coupled to the mixing tube support 61 by a separate coupling member such as a screw.

In such a burner system, the mixing tube unit 6 and the burner pot 4 may be aligned at desired positions by slightly inserting discharge ends of the mixing tubes 62 to the burner pot 4. After this alignment, the burner pot 4 and the mixing tube unit 6 may be firmly coupled with each other by a separate coupling member such as a screw. Here, the mixing tube unit 6 is already in a state where the plurality of mixing tubes 62 are coupled to the mixing tube support 61.

To align the mixing tube unit 6 and the nozzle unit 5 at desired positions, each mixing tube leg 63 includes a modification portion 64 at an end portion, and each nozzle leg 54 includes a corresponding modification portion 55 at an end portion, corresponding to the modification portion 64. The modification portion 64 and the corresponding modification portion 55 each have modified parts from which modifications to respective original shapes of the legs 63 and 54 begin, and the modified parts contact each other, so that the nozzle unit 5 and the mixing tube unit 6 can be positioned at the desired positions with high precision.

The modification portion 64 and the corresponding modification portion 55 will now be described in more detail. For example, the modification portion 64 has a vertical height difference from an original shape of the mixing tube leg 63 by perpendicularly stepping the original shape of the mixing tube leg 63. In more detail, the modification portion 64 is provided by stepping perpendicularly downwardly the original shape of the mixing tube leg 63. The corresponding modification portion 55 corresponds to the modification portion 55, and is provided by upwardly stepping an original shape of the nozzle leg 54. When the modification portion 64 and the corresponding modification portion 55 are aligned at corresponding positions in a vertical direction, the stepped parts thereof contact each other, so that the mixing tube leg 63 and the nozzle leg 54 can be aligned vertically with high precision.

As mentioned above, the modification portion 64 and the corresponding modification portion 55 guide vertical relative placement of the mixing tube leg 63 and the nozzle leg 54 with high precision. Thus, from a functional perspective, the modification portion 63 and the corresponding modification portion 55 may be named vertical guides.

Of course, the mixing tube leg 63 and the nozzle leg 54 are automatically aligned in a forward and rear direction because of the respective height differences in the modification portion 64 and the corresponding modification portion 55. When vertical and horizontal alignment is precisely made, the distance between the nozzle 53 and the inlet of the mixing tube 62 can be precisely set.

The modification portion 64 and the corresponding modification portion 55 can allow the legs 63 and 54 to be reliably and stably placed at the preset positions with high precision. Furthermore, the legs 63 and 54 also contribute to precisely aligning the relative positions between the nozzle 53 and the mixing tube 62. For this reason, stable combustion performance of the burner system can be achieved, and stable performance of the mixing tube unit 6 and the nozzle unit 5 can be obtained despite compactness of the heating cooking appliance. Also, assembly of the mixing tube unit 6 and the nozzle unit 5 can be facilitated. Since the legs 63 and 54 are coupled so that the nozzle 53 and the mixing tube 62 are placed at the precise relative positions, the legs 63 and 54 can be named coupling parts.

After the modification portion 64 and the corresponding modification portion 55 precisely align the legs 63 and 54, the nozzle unit 5 and the mixing tube unit 6 may be finally coupled with each other by inserting screws 69 into screw holes correspondingly formed in the respective legs 63 and 54. The coupling of the legs 63 and 54 using the screws 69 may contribute to facilitating operations such as nozzle exchange or repair. The coupling method of the nozzle unit 5 and the mixing tube unit 6 is not limited to the insertion of the screws 69 into the screw holes, and various coupling methods such as rivet coupling, bolt-nut coupling, and coupling using clips may be employed provided that the coupling method allows separation between the nozzle unit 5 and the mixing tube unit 6 for repair to be performed later.

Embodiment 2

Figure 6:
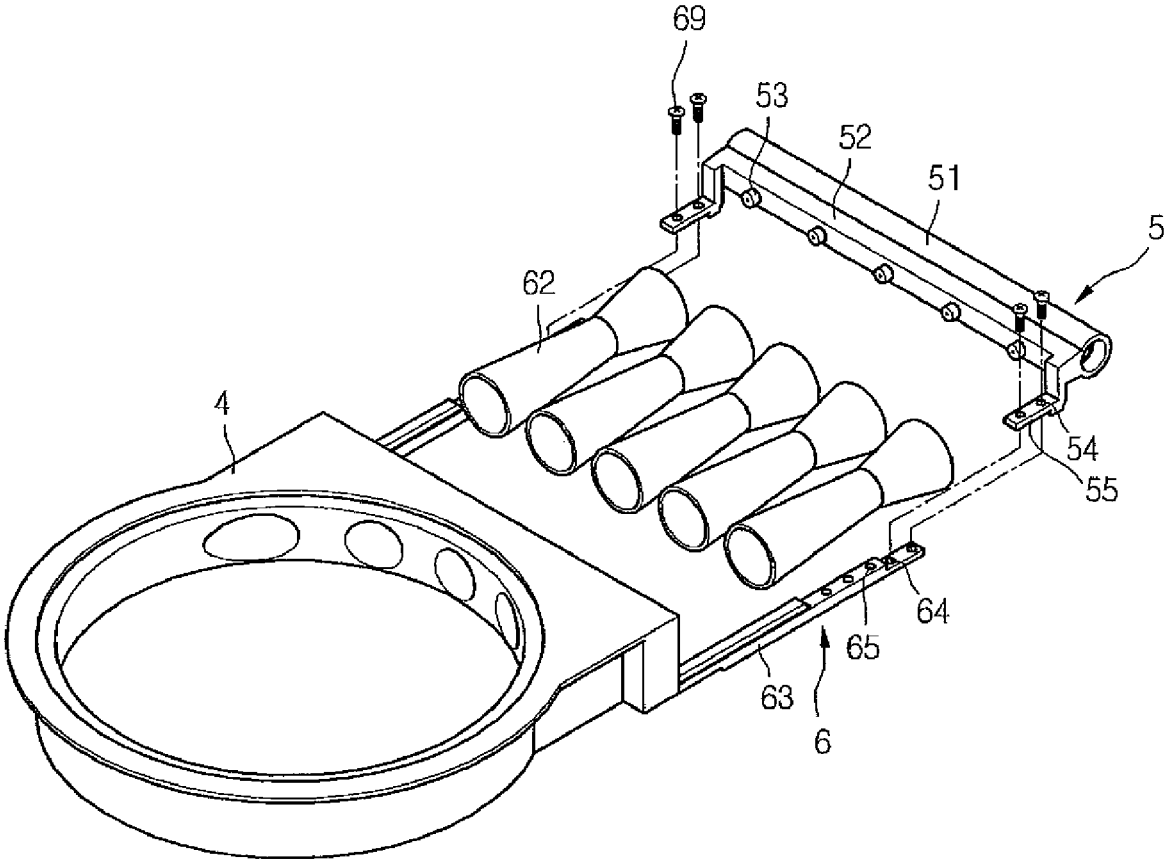
FIG. 6 is a perspective view of a burner system according to a second embodiment.

FIG. 6 is a perspective view of a burner system according to a second embodiment. The second embodiment is similar to the first embodiment. Therefore, description of the same parts of the second embodiment as the first embodiment will be omitted, and only differences therebetween will be described in detail.

Referring to FIG. 6, the mixing tube support 61 is formed integrally with the burner pot 4. The mixing tube 62 may be fixed to the burner pot 4 by a screw insertion method. Even though the mixing tube 62 must be separately inserted into the burner pot 4, the burner pot 4 and the mixing tube 62 can be precisely aligned.

As in the burner system according to the first embodiment, reliability of alignment according to the current embodiment can be improved by the legs 63 and 54 and the modification portions 64 and 55 when the nozzle unit 5 and the mixing tube unit 6 are coupled with each other.

Embodiment 3

Figure 7:
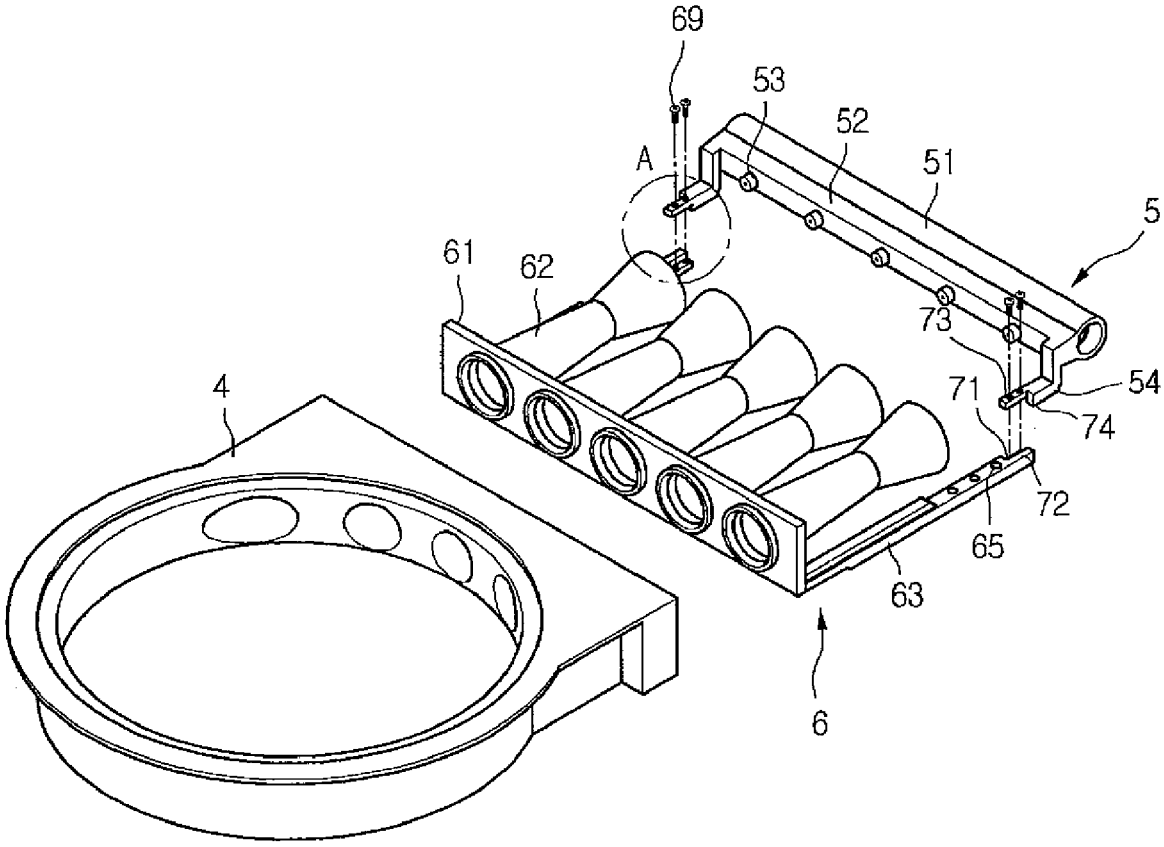
FIG. 7 is a perspective view of a burner system according to a third embodiment.
Figure 8:
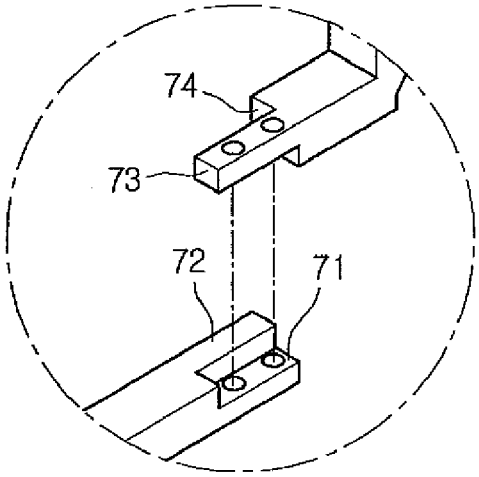
FIG. 8 is an enlarged view of part A of FIG. 7.

FIG. 7 is a perspective view of a burner system according to a third embodiment, and FIG. 8 is an enlarged view of part A of FIG. 7. The burner system according to the third embodiment is the same as that of the first embodiment, except for a modification portion and a corresponding modification portion. Thus, description of the same parts will be omitted, and only the difference between the burner systems of the first embodiment and the third embodiment will be described in detail.

Referring to FIGS. 7 and 8, a vertical modification portion 71 and a horizontal modification portion 72 correspond to the modification portion 64 of the first embodiment. A vertical corresponding modification portion 73 and a horizontal corresponding modification portion 74 correspond to the corresponding modified portion 55 of the first embodiment. In detail, the vertical modification portion 71 is formed similarly to the modification portion 64 of the first embodiment, and the vertical corresponding modification portion 73 is formed similarly to the corresponding modification portion 55 of the first embodiment. Thus, the legs 63 and 54 according to the third embodiment can guide relative positions of the mixing tube unit 6 and the nozzle unit 5 in a vertical direction.

According to the third embodiment, when the legs 63 and 54 are aligned with each other, the horizontal modification portion 72 and the horizontal corresponding modification portion 74 contact each other, thereby stopping and supporting the legs 63 and 54 at the contacting position. Accordingly, the legs 63 and 54 can stably guide the relative positions of the mixing tube unit 6 and the nozzle unit 5 in a horizontal direction.

Since the alignment of the legs 63 and 54 is guided in a vertical direction, in a forward and rearward direction, and in a left and right direction, the mounting process of the legs 63 and 54 is facilitated, and reliability of the alignment of the nozzle 53 and the mixing tube 62 can be improved. Of course, in the current embodiment, the nozzle unit 5 can be separated from the mixing tube unit 6 by lifting up the nozzle unit 5.

Embodiment 4

Figure 9:
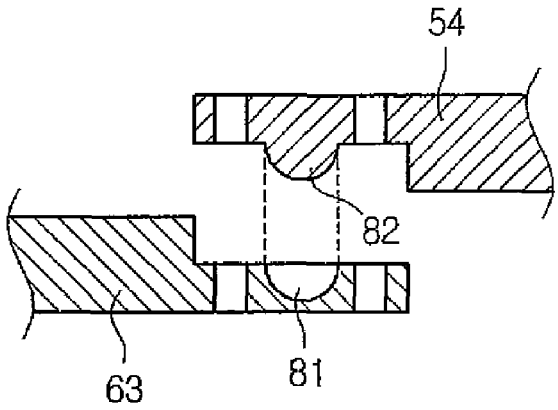
FIG. 9 is a perspective view of a burner system according to a fourth embodiment.

FIG. 9 is a perspective view of a burner system according to a fourth embodiment. The fourth embodiment is the same as the first embodiment, except for a modification portion and a corresponding modification portion, and thus description of the same parts of the current embodiment as those in the first embodiment will be omitted, and only the difference therebetween will be described in detail.

Referring to FIG. 9, a modification portion 81 is formed by recessing any one of the legs 63 and 54 in the form of a groove or hole, and a corresponding modification portion 82 is formed on the other leg in the form of a protrusion.

A base portion of the modification portion 81 where the recessing begins may have a shape fitting in at least a base portion of the corresponding modification portion 82. Thus, when the pair of legs 63 and 54 is aligned, they can be placed at preset positions with high precision.

Since the rounded shapes are provided according to the current embodiment, there is no need to additionally provide the vertical modification portion and the horizontal modification portion according to the third embodiment. Accordingly, the rounded shapes allow the legs 63 and 54 to be conveniently aligned in every movement direction, that is, in a forward and rearward direction, a vertical direction, and a left and right direction.

Embodiment 5

Figure 10:
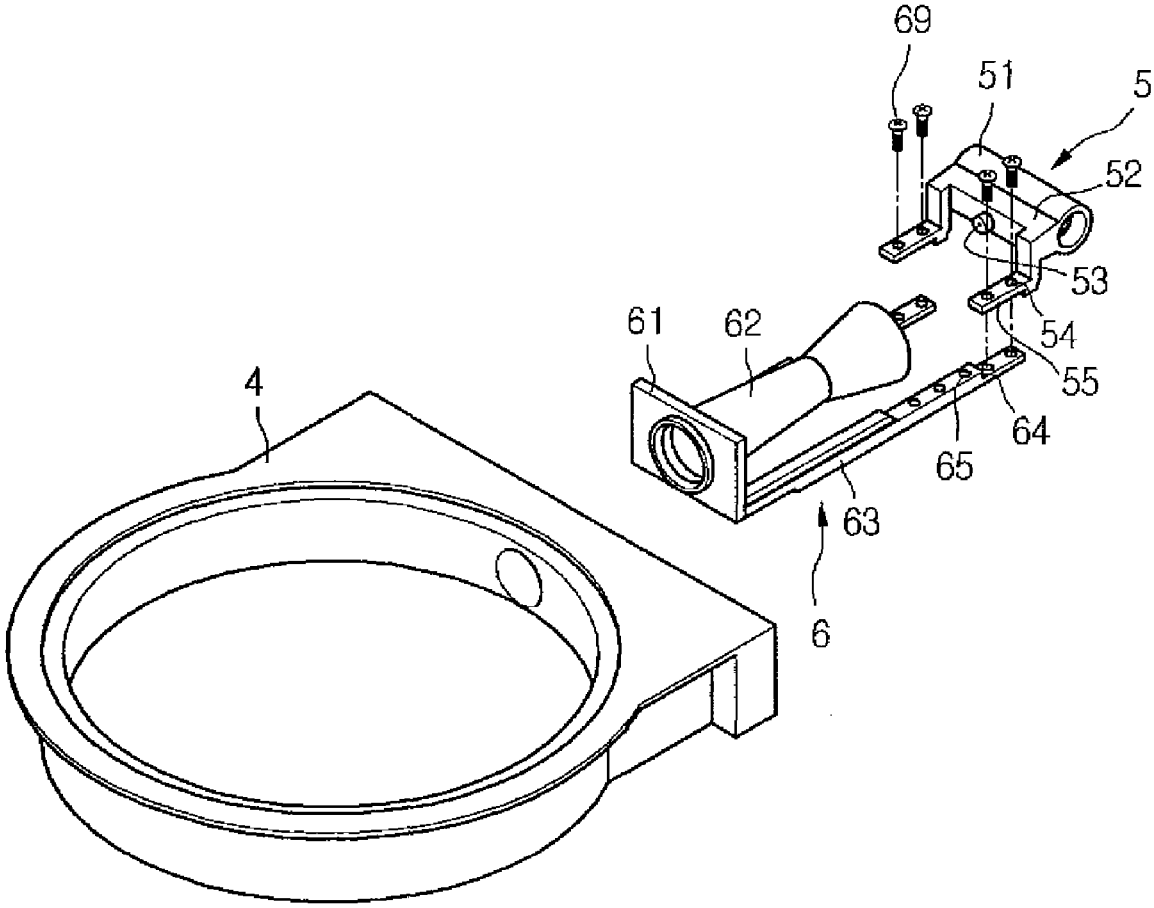
FIG. 10 is a perspective view of a burner system according to a fifth embodiment.

FIG. 10 is a perspective view of a burner system according to a fifth embodiment. The fifth embodiment is the same as the first embodiment, except for the number of mixing tubes and the nozzle. Therefore, description of the same parts of the fifth embodiment as those in the first embodiment will be omitted, and only the difference therebetween will be described in detail.

Referring to FIG. 10, one mixing tube 62 and one nozzle 53 are provided according to the current embodiment. To align the mixing tube 62 and the nozzle 53 with each other with high precision, legs 63 extend from both sides of the mixing tube 62, and legs 54 extend from the nozzle holder 5 to face the respective legs 63 of the mixing tube 62. Of course, a modification portion and a corresponding modification portion are formed in the same manner as described in the previous embodiment.

Accordingly, the relative positions of the mixing tube 62 and the nozzle 53 can be aligned with high precision.

Embodiments are not limited to the aforementioned embodiments, the following embodiments may be further provided.

Although the nozzle legs and the mixing tube legs are respectively provided in pairs in the aforementioned embodiments, one nozzle leg and one mixing tube leg may be provided, or three or more nozzle legs and three or more mixture pip legs may be provided. One leg may be provided when one opening and one mixing tube are provided, but if one leg is provided in the case where a plurality nozzles and a plurality of mixing tubes are respectively provided for the nozzle unit and the mixing tube unit, the alignment may become difficult. When three or more nozzles and three or more mixing tubes are provided, three or more legs are provided to improve reliability of the alignment between the nozzle unit and the mixing tube unit.

Although the modification portion and the corresponding modification portion are respectively formed in bar-shaped legs of the nozzle unit and the mixing tube unit extending to face each other in the aforementioned embodiments, the modification portion and the corresponding modification portion may be respectively provided in plate-shaped parts corresponding to each other, or may be respectively provided in any portions that widely expand from respective ends of the legs. Any portion extending from any member fixed to the mixing tube and any portion extending from any member fixed to the nozzle may be modified at a position where the portions overlap each other, and be aligned with each other, so that the functions of the modification portion and the corresponding modification portion can be performed.

Although the legs extend to face each other from a lower side of the mixing tube support to which a plurality of mixing tubes are aligned and fixed, and from a lower of the nozzle holder to which a plurality of nozzles are fixed in the aforementioned embodiments, the legs may directly extend from the mixing tube, and may directly extend from the nozzle by modifying the nozzle or may extend from the a distribution tube. Particularly, in the case where one mixing tube and one nozzle are formed, a mixing tube leg extending from the mixing tube may be considered convenient. Of course, convenience is improved when the legs extend from the mixing tube support and the nozzle holder to face each other with regard to factors associated with a distance and convenient manufacturing.

The modification portion and the corresponding modification portion are described as portions formed by modifying original shapes of the legs for convenient coupling of the legs.

According to embodiments, even if a heating cooking appliance includes a narrow internal space, a nozzle and a mixing tube can be stably fixed, and relative positions of components of the heating cooking appliance can be precisely aligned, thereby improving operational reliability of the heating cooking appliance.

Also, an operator can easily assemble the burner system so that the components are prevented from being mistakenly misaligned, and a nozzle, a mixing tube and a burner pot can be placed at preset positions with high precision.

For example, when the nozzle needs to be repaired, the nozzle unit can be separated just by unfastening a coupling member such as a screw, and the nozzle unit can be coupled precisely at a desired position after being repaired.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A burner system comprising:

a nozzle unit provided with at least one nozzle configured to spray gas;

a mixing tube unit provided with at least one mixing tube apart from the nozzle to introduce air together with the gas therein;

a burner pot providing a mixing space in which the gas and air introduced through the mixing tube unit are uniformly mixed;

a nozzle coupling part configured to fix a position of the nozzle;

a mixing tube coupling part configured to fix a position of the mixing tube, the mixing tube coupling part being formed on the burner pot and extending from the burner pot toward the nozzle coupling part; and a guide unit configured to align at least a part of the nozzle coupling part with at least a part of the mixing tube coupling part so that a relative positional relation between the nozzle unit and the mixing tube unit is precisely set, wherein the guide unit includes a first guide unit formed on the nozzle coupling part and a second guide unit formed on the mixing tube coupling part, the first guide unit interacting with the second guide unit, and the first guide unit formed in a shape corresponding to the second guide unit.

2. The burner system according to claim 1, wherein the guide unit limits movements of the nozzle unit and the mixing tube unit in a vertical direction and a forward and backward direction.

3. The burner system according to claim 1, wherein the guide unit limits every movement of the nozzle unit and the mixing tube unit except for a movement in one direction.

4. The burner system according to claim 1, wherein one of the first guide unit and the second guide unit is a recess and the other of the first guide unit and the second guide unit is a protrusion inserted in the recess.

5. The burner system according to claim 1, wherein the nozzle coupling part is provided as a pair at both ends of nozzle unit, and the mixing tube coupling part is provided as a pair at both ends of the mixing tube unit.

6. The burner system according to claim 1, wherein the mixing tube unit is connected to a side surface of the burner pot.

7. The burner system according to claim 1, wherein the nozzle unit includes:

a distribution tube; and a nozzle holder configured to fix the nozzle, from which the nozzle coupling part extends, wherein the guide unit is placed at an end portion of the nozzle coupling part.

8. The burner system according to claim 1, wherein the mixing tube unit includes a mixing tube support coupled to the burner pot and configured to support the mixing tube, wherein the mixing tube coupling part extends from the mixing tube support.

9. The burner system according to claim 1, wherein the mixing tube is directly coupled to the burner pot, and the mixing tube coupling part extends from the burner pot.

* * * * *